US009617682B2

(12) United States Patent
Pelland

(10) Patent No.: US 9,617,682 B2
(45) Date of Patent: Apr. 11, 2017

(54) QUILTING TEMPLATE

(71) Applicant: Susan Pelland, Upton, MA (US)

(72) Inventor: Susan Pelland, Upton, MA (US)

(73) Assignee: Susan Pelland, Upton, MA (US)

( * ) Notice: Subject to any disclaimer, the term of this patent is extended or adjusted under 35 U.S.C. 154(b) by 213 days.

(21) Appl. No.: 14/519,690

(22) Filed: Oct. 21, 2014

(65) Prior Publication Data

US 2015/0107127 A1 Apr. 23, 2015

Related U.S. Application Data

(60) Provisional application No. 61/893,514, filed on Oct. 21, 2013.

(51) Int. Cl.

| | |
|---|---|
| ***D06H 7/00*** | (2006.01) |
| ***B43L 13/20*** | (2006.01) |
| ***D06H 7/24*** | (2006.01) |

(52) U.S. Cl.

CPC ..... *D06H 7/00* (2013.01); *B43L 13/201* (2013.01); *D06H 7/24* (2013.01); *Y10T 83/04* (2015.04)

(58) Field of Classification Search

CPC ..... D06H 7/00; B43L 13/201
USPC ..... 33/566, 562, 563, 565, 561.1; D10/64
See application file for complete search history.

(56) References Cited

U.S. PATENT DOCUMENTS 360,545 A * 4/1887 Wagner ..... B43L 13/201 33/485
616,493 A * 12/1898 Richardson ..... A41H 3/002 33/11
1,409,723 A * 3/1922 Jacob ..... B43L 13/20 33/1 A
2,579,857 A * 12/1951 Premo ..... B43L 13/20 33/476
4,053,986 A * 10/1977 Axelrod ..... D04D 7/02 112/475.04
4,502,232 A 3/1985 Broders
4,524,522 A * 6/1985 Perry ..... A41H 3/002 33/11
4,945,642 A * 8/1990 Saulietis ..... D05B 97/12 33/12
6,276,070 B1 * 8/2001 Hawley ..... B43L 7/033 33/1 G
6,443,081 B1 * 9/2002 Quint ..... D05B 97/12 112/439
6,944,963 B2 9/2005 Amaru
(Continued)

*Primary Examiner* — Christopher Fulton

(74) *Attorney, Agent, or Firm* — Duquette Law Group, LLC

(57) ABSTRACT

A template, such as a quilting template, is configured as a relatively thin piece of material having a first circular portion disposed at a first end of the template and a second circular portion disposed at a second end of the template. The template further includes a concave curve portion disposed between the first end and the second end along a first side edge of the template, a linear curve portion disposed between the first end and the second end along a second side edge of the template, and a set of guide markings. In use, a user can utilize the template to cut, for example, heart-shaped, flower-shaped, or leave-shaped elements, from a piece of material. With such a configuration, the template allows the user to cut a variety of differently sized and shaped elements directly from the material, without requiring the creation of multiple patterns.

15 Claims, 18 Drawing Sheets

(56) References Cited

U.S. PATENT DOCUMENTS

| | | | | |
|---|---|---|---|---|
| 7,827,701 | B2 * | 11/2010 | Wharton | B26B 29/06 33/562 |
| 8,011,111 | B2 * | 9/2011 | Brady | B26B 29/06 33/494 |
| 2003/0070313 | A1 * | 4/2003 | Romer | B31B 41/00 33/566 |
| 2006/0244254 | A1 * | 11/2006 | Repp | B42D 15/00 283/117 |

* cited by examiner

QUILTING TEMPLATE

RELATED APPLICATIONS

This patent application claims the benefit of U.S. Provisional Application No. 61/893,514, filed on Oct. 21, 2013, entitled, "Quilting Template," the contents and teachings of which are hereby incorporated by reference in their entirety.

BACKGROUND

Quilt construction is based on a foundation of individual fabric elements that are joined together at the edges, typically by sewing, to form blocks. These blocks are then joined together in a process known as piecing to form a larger quilt top.

To add ornamentation on the surface of the quilt, quilt makers may utilize a technique known as appliqué. In this process, quilt makers create specific, custom patterns for specific shapes, based upon the ornamentation to be applied to the quilt. For example, the quilt maker draws a pattern on a sheet of relatively thin plastic material and cuts the pattern from the sheet using a pair of scissors. The quilt maker then uses the pattern to trace one or more like-shaped appliqué elements on a piece of fabric material. The quilt maker then cuts the traced appliqué elements from the material using scissors. The quilt maker can then attach the appliqué elements to the quilt using a variety of techniques to form the final quilt top.

SUMMARY

Conventional appliqué creation techniques suffer from a variety of deficiencies. As indicated above, a quilt maker must create distinct patterns for specific fabric appliqué shapes to be applied to a quilt. For a quilt requiring multiple appliqué shapes, the process of creating separate patterns for each appliqué shape can be time consuming and can discourage the user from assembling the quilt.

To reduce the time involved in cutting patterns for the creation of appliqué shapes, certain manufacturers have developed die-cutting machines that are configured to die cut fabric material into specific appliqué shapes. However, for each distinct appliqué shape required to be stamped from a fabric material, the die-cutting machine requires a correspondingly shaped stamping element (e.g., stamping blade). Accordingly, if a quilting project requires five distinct appliqué shapes, the quilt maker must purchase five distinctly shaped stamping elements to create the corresponding appliqué shapes. For the non-commercial quilt maker, this can be expensive. Additionally, the use of the die cutting machines can generate a relatively large volume of fabric waste, as the quilt maker may not be able to optimize the number of appliqué shapes to be generated from a single piece of fabric. Again, for the non-commercial quilt maker, this can become expensive.

By contrast to conventional devices used to generate appliqé patterns, embodiments of the present innovation relate to a template, such as a quilting template. In one arrangement, the template is configured as a relatively thin piece of material having a first circular portion disposed at a first end of the template and a second circular portion disposed at a second end of the template. The template further defines a concave curve portion disposed between the first end and the second end along a first side edge of the template. The template also defines a linear curve portion disposed between the first end and the second end along a second side edge of the template, as well as a set of guide markings disposed about the outer periphery of the template. In use, a user can utilize the template to cut a variety of appliqé shapes, such as heart-shaped, flower-shaped, or leave-shaped elements, from a piece of material. Accordingly, the template allows the user to cut a variety of differently sized and shaped elements directly from the material, without requiring the creation of multiple patterns or the purchase of multiple stamping elements for a die machine. Accordingly, use of the template saves the user time and expense during a quilting project.

In one arrangement, a template includes a sheet of substantially flat material defining a thickness and having a first end and a second end, the first end opposing the second end, at least one of the first end and the second end defining a circular portion having a radius. The sheet defines a concave curve portion disposed between the first end and the second end along a first side edge of the sheet. The sheet defines a linear curve portion disposed between the first end and the second end along a second side edge of the sheet, the second side edge opposing the first side edge. The template includes a set of template markings disposed on the sheet, the set of template markings configured to define a cutting shape.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation relate to a template, such as a quilting template. In one arrangement, the template is configured as a relatively thin piece of material having a first circular portion disposed at a first end of the template and a second circular portion disposed at a second end of the template. The template further defines a concave curve portion disposed between the first end and the second end along a first side edge of the template. The template also defines a linear curve portion disposed between the first end and the second end along a second side edge of the template, as well as a set of guide markings disposed about the outer periphery of the template. In use, a user can utilize the template to cut a variety of appliqué shapes, such as heart-shaped, flower-shaped, or leave-shaped elements, from a piece of material. Accordingly, the template allows the user to cut a variety of differently sized and shaped elements directly from the material, without requiring the creation of multiple patterns or the purchase of multiple stamping elements for a die machine. Accordingly, use of the template saves the user time and expense during a quilting project.

Figure 1:
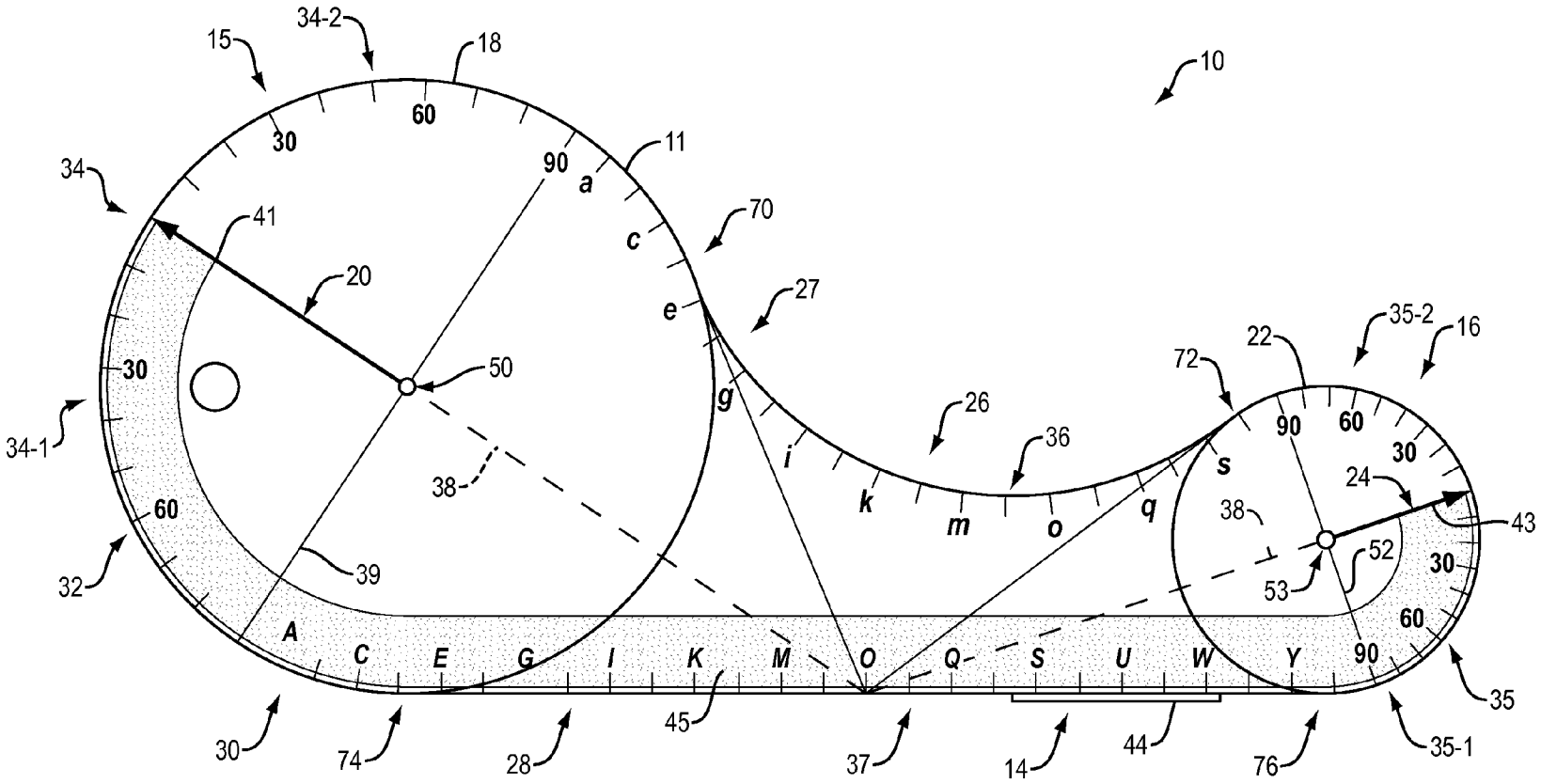
FIG. 1 illustrates a front view of a template, according to one arrangement.
Figure 2:
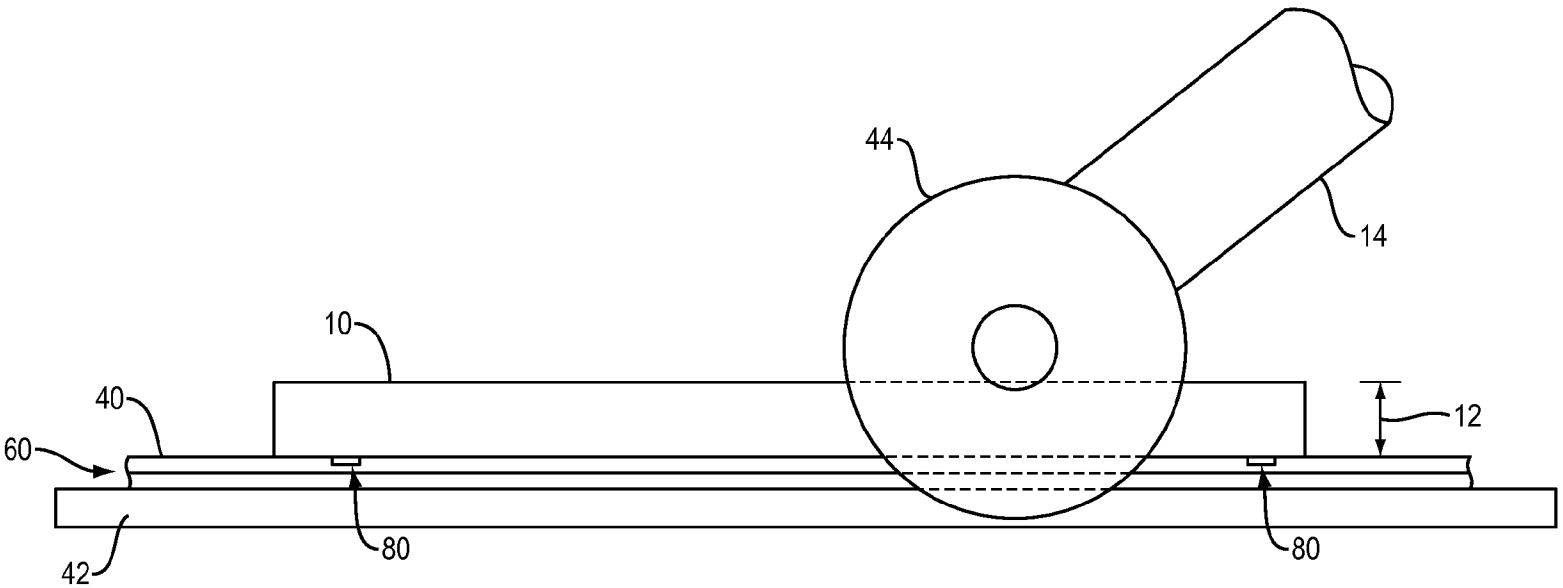
FIG. 2 illustrates a side view of the template of FIG. 1, according to one arrangement.

FIGS. 1 and 2 illustrate an arrangement of a template 10, such as a quilting template, according to one arrangement. The template 10 is manufactured from a sheet of substantially flat material 11 having a relatively small thickness 12. In one arrangement, with reference to FIG. 2, the template 10 defines a thickness 12 of between about 1/16 inch and 1/4 inch. In the case where the thickness 12 is about 1/8 inch, the template 10 is configured to be used with rotary cutter 14, such as an 18 mm or a 28 mm diameter rotary cutter, to create appliqé elements. In the case where the thickness 12 is about 1/4 inch, the template 10 can be configured for use with a sewing machine to create a stitching design in a piece of fabric.

The template 10 can be manufactured from a variety of materials. For example, the template 10 can be manufactured from a plastic or acrylic material. In one arrangement, the plastic material is configured as a substantially transparent plastic material to provide a user with the ability to accurately position of the template 10 relative to a piece of fabric prior to cutting.

Returning to FIG. 1, the template 10 includes a first end 15 and a second end 16 opposing the first end 15. The first end 15 defines a first circular portion 18 having a first radius 20 and the second end 16 defines a second circular portion 22 having a second radius 24. As is indicated in FIG. 1, the first radius 20 of the first circular portion 18 is distinct from (e.g., larger than) the second radius 24 of the second circular portion 22. For example, the template 10 can be configured with the following radii 20, 24 for the first and second circular portions 18, 22, respectively.

| First radius (inches) | Second radius (inches) |
|---|---|
| 13/16 | 1/2 |
| 1 1/4 | 7/8 |
| 2 | 1 |
| 2 1/2 | 1 1/2 |

With the inclusion of two differently sized circular portions 18, 22, the template 10 is configured to allow a user to generate a variety of differently sized appliqé elements. In one arrangement, each template 10 of the above-listed templates (e.g., the templates having differently sized first and second circular portions 18, 22) form part of a set of templates.

The template 10 further defines a concave curve portion 26 disposed between the first end 15 and the second end 16 along a first side edge 27 of the template 10. For example, as illustrated, the concave curve portion 26 extends from the first circular portion 18 at a location 70 disposed at approximately +145° from radial marker 41 to the second circular portion 22 at a location 72 disposed at approximately −110° from radial marker 43. The template 10 also defines a linear curve portion 28 disposed between the first end 15 and the second end 16 along a second side edge 30 of the template 10. For example, as illustrated, the linear curve portion 28 extends from the first circular portion 18 at a location 74 disposed at approximately −145° from radial marker 41 to the second circular portion 22 at a location 76 disposed at approximately +110° from radial marker 43. As will be described below, inclusion of the concave curve portion 26 and the linear curve portion 28 provides a user with the ability to generate appliqé elements having a variety of shapes.

With continued reference to FIG. 1, the template 10 also includes a set of template markings 32 utilized by an end user to define a cutting shape. For example, each of the first and second circular portion 18, 22 includes curvature markings 34, 35, respectively, that define an angle of curvature of the template 10 relative to a piece of material. While the curvature markings 34, 35 can be configured in a variety of ways, in one arrangement, the markings 34, 35 are configured as numerical markings that indicate the angular locations of the outer periphery of the first and second circular portions 18, 22 relative to a reference line 38.

As illustrated in FIG. 1, taking the second circular portion 22 as an example, the circular portion 22 includes two subsets of numerical markings 35. The first subset 35-1 extends towards the linear curve portion 28 and indicate the +30°, +60°, and +90° locations on the circular portion 22 relative to a radial marker 43. The second subset of numerical markings 35-2 extend toward the concave curve portion 26 and indicate the −30°, −60°, and −90° locations on the circular portion 22 relative to the radial marker 43.

In order to distinguish the first and second subsets of numerical markings 35-1, 35-2, the template 10 can be configured with a visual indicator 45. For example as indicated in FIG. 1, the template 10 can include as the visual indicator 45 a transparent colored band that extends from the first end 15 at radial marker 41 toward the second end 16 at radial marker 43 along the linear curve portion 28 and that highlights the upper case letters of the linear curve portion 28. With such highlighting, the visual indicator 45 allows a user to visually distinguish the first and second subsets of numerical markings 35-1, 35-2 on the second circular portion 22, as well as subsets of the curvature markings 34-1, 34-2 on the first circular portion 18.

Additionally, the side edges 26, 30 of the template 10 include template markings 32 such as depth markings 36, 37, respectively, that define a depth of curvature of the template 10 relative to a piece of material. While the depth markings 36, 37 can be configured in a variety of ways, in one arrangement, the markings 36, 37 are configured as letters that indicate the locations of the concave curve portion 26 and the linear curve portion 28 relative to a reference line 39. In order to distinguish the depth markings 36 of the concave curve portion 26 from the depth markings 37 of the linear curve portion 28, the concave curve depth markings 36 can be configured as lower case letters and the linear curve depth markings 37 can be configured as upper case letters. As will be described below, the curvature and depth markings 34, 35, 36, 37 provide the user with a guide to generate reproducible appliqé elements for a given project.

As is indicated in FIGS. 1 and 2, the template 10 is configured to be used in conjunction with a rotary cutter 14, such as an 18 mm diameter rotary cutter used when cutting through a single material layer, or such as a 28 mm diameter rotary cutter used when cutting through multiple layers of material. With reference to FIG. 2, during operation, a user folds a piece of material 40 such that a first portion of the material overlaps a second portion of the material to define a fold line 60 and places the material 40 on a cutting mat 42, such as a rotatable cutting mat. The user then aligns the template 10 and template markings 32 relative to the material 40 and the fold line 60 in a particular manner for a particular design, examples of which are provided below. The user then places a blade 44 of the rotary cutter 14 against an edge of the template 10, such as illustrated in FIG. 1, and rolls the blade 44 along the edge of the template 10 to create an appliqé element, based upon the position of the markings 34, 36. Accordingly, the template 10 provides for the creation of reproducible appliqé elements.

As indicated above, the template 10 is configured to be used to generate a variety of appliqé elements having different shapes and sizes. The following provides a description of various example shapes that can be created using the template 10.

In one arrangement, the template 10 is configured to allow a user to create four different types of heart shapes from a piece of material. For example, the template 10 allows the creation of a short, straight-edged heart appliqé element, an elongated, straight-edged heart appliqué element, a short, round-edged heart appliqé element, and an elongated, round-edged heart appliqé element.

Figure 3A:
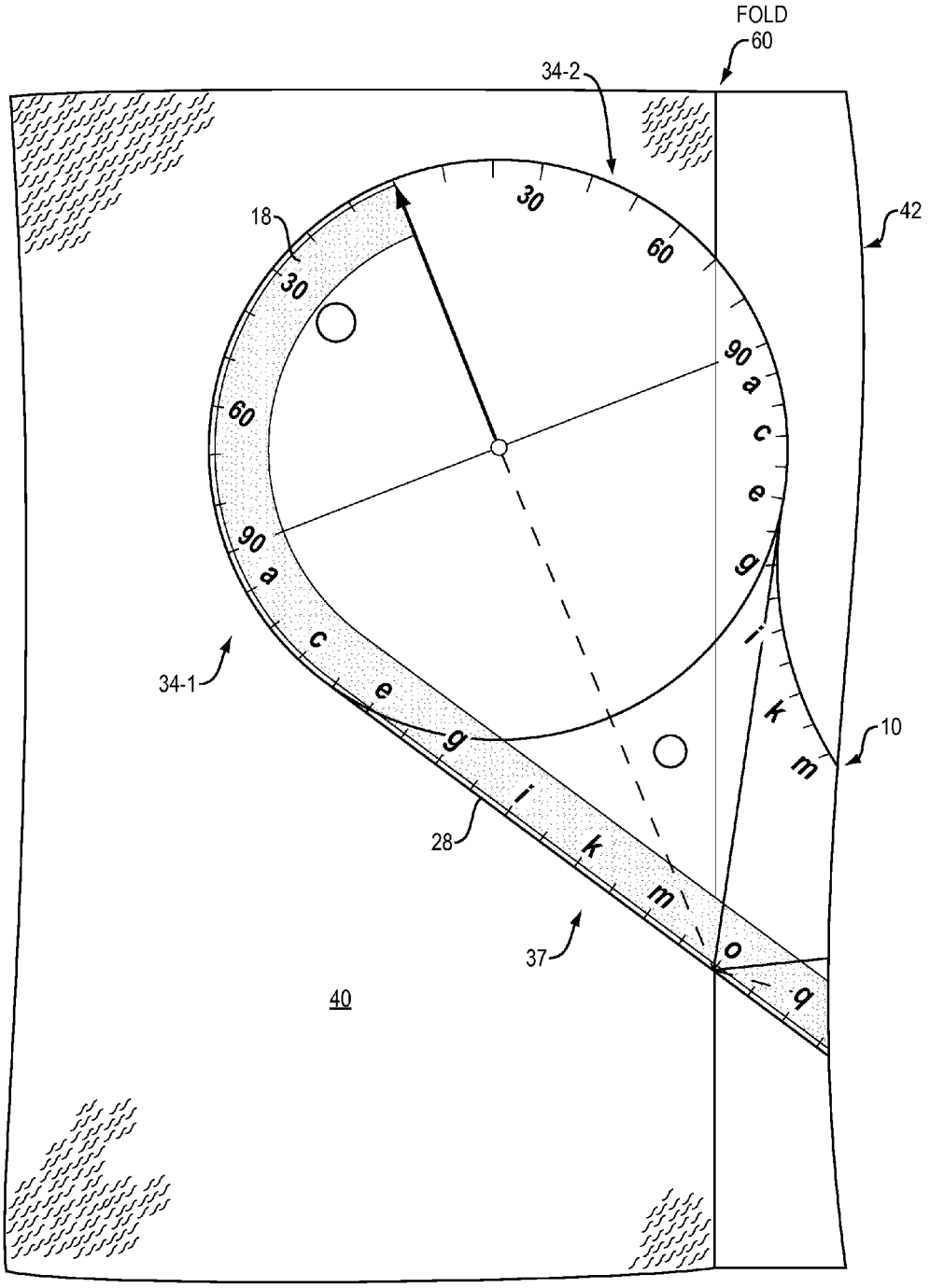
FIG. 3A illustrates the use of the template of FIG. 1 to create a substantially short, straight edge heart.
Figure 3B:
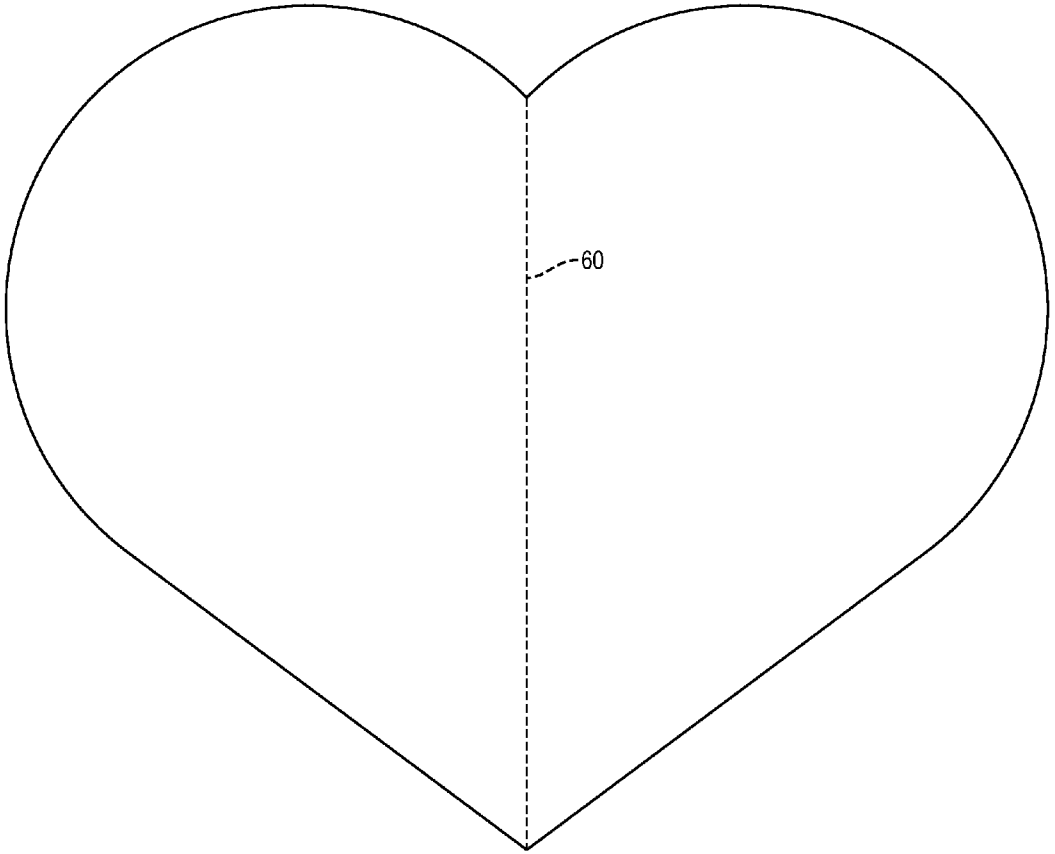
FIG. 3B illustrates an example of a substantially short, straight edge heart appliqué created by the template of FIG. 1.

FIG. 3A illustrates an example use of the template 10 to create a short, straight-edged heart. First the user folds the material 40 and places the fold line 60 on a right-hand side of the cutting mat 42. The user then places the linear curve portion 28 on the material (i.e., to the left of the fold 60) and aligns a marking of the second subset of the curvature markings 34-2, such as the 70° mark of the markings 34-2 with the fold 60. The user then aligns a depth marking 37 of the linear curve portion 28, such as the "o" mark of the second set of depth markings 37 with the fold 60. The user then utilizes a rotary cutter 14 to cut from the 70° mark along the first circular portion 18 and along the linear curve portion 28 to the "o" mark. Once completed, the user can remove the template 10 from the material 40 and can lift and unfold the cut material into the shape of a short, straight-edged heart appliqé element, as illustrated in FIG. 3B.

Figure 4A:
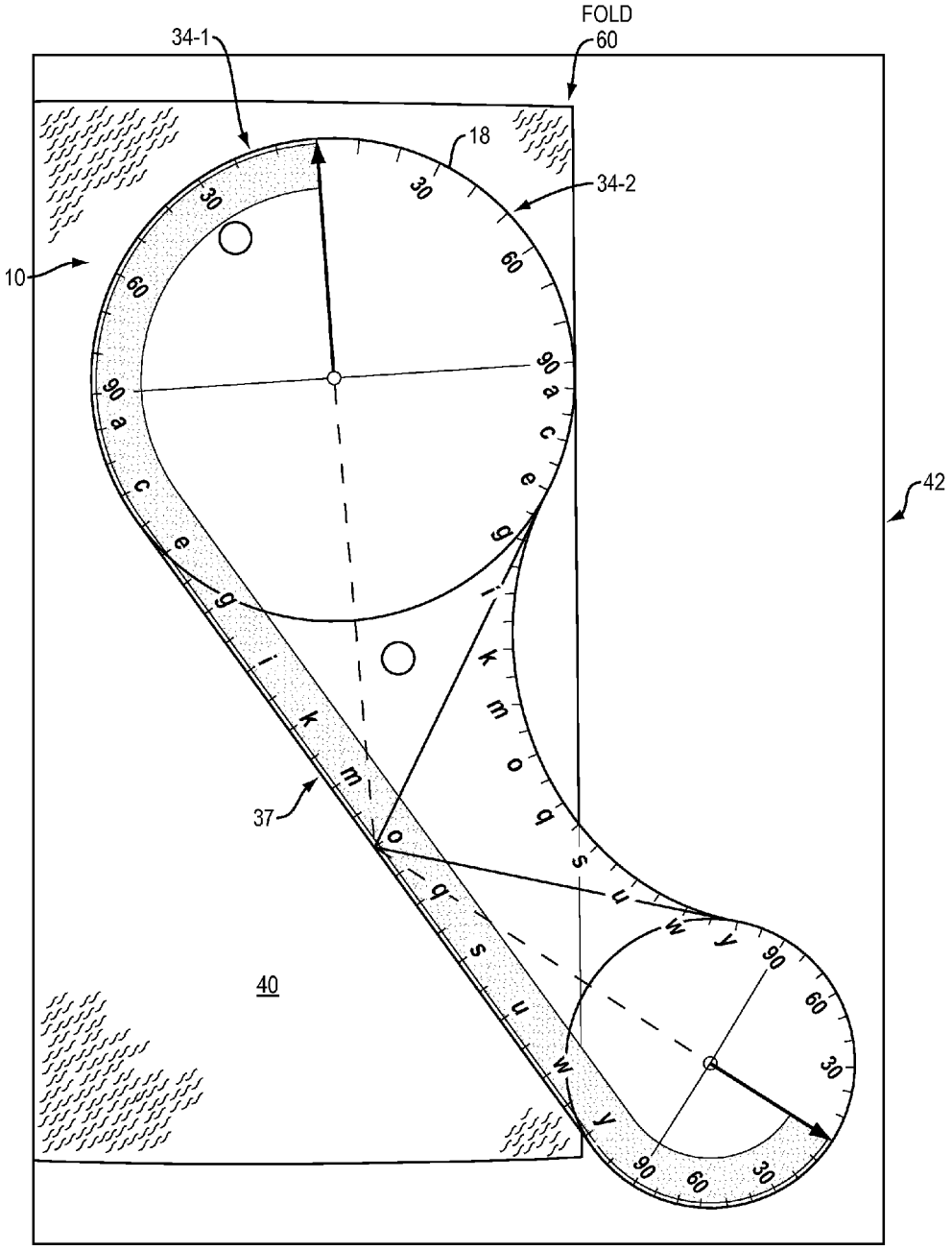
FIG. 4A illustrates the use of the template of FIG. 1 to create an elongated, straight edge heart.
Figure 4B:
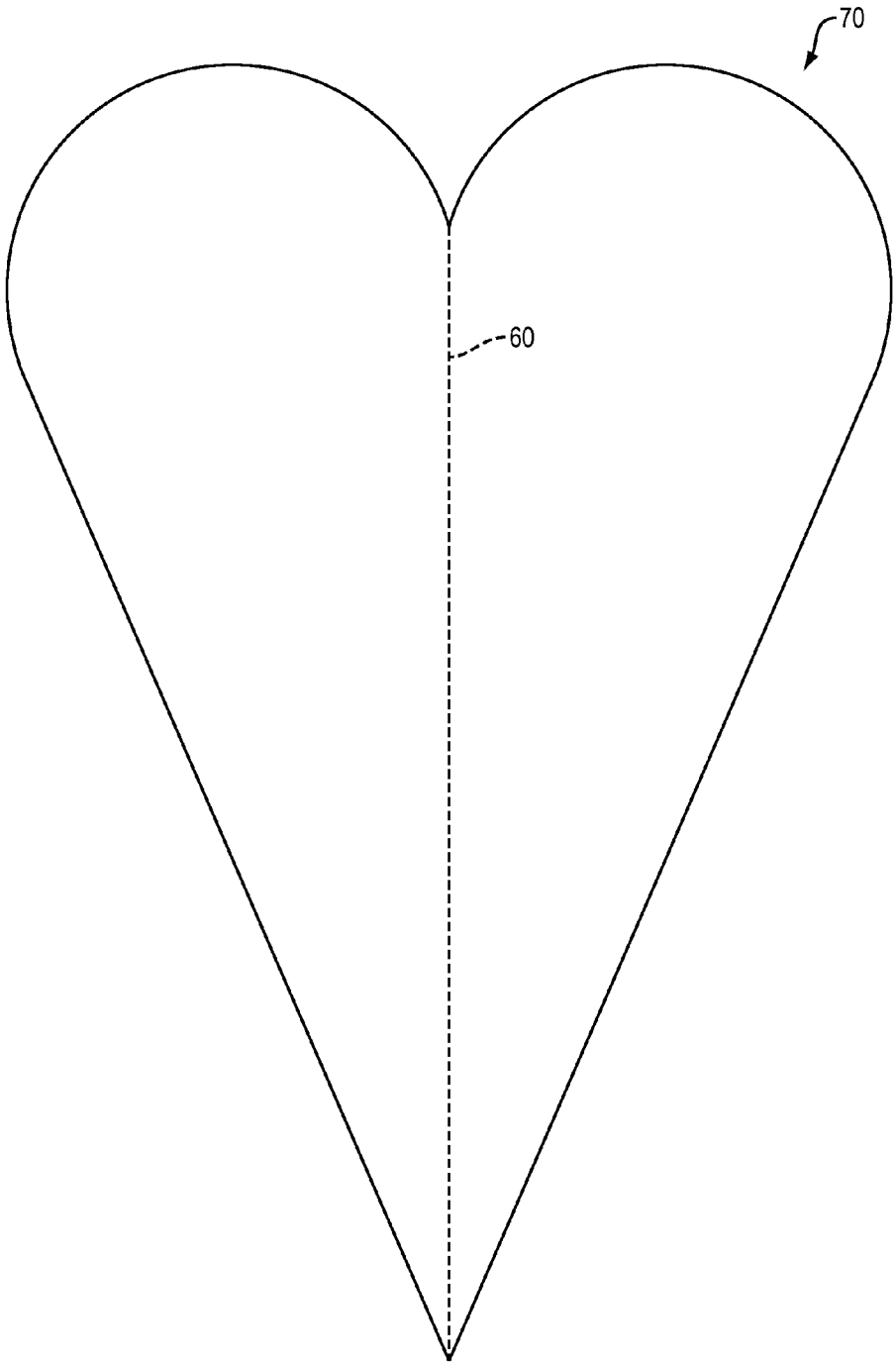
FIG. 4B illustrates an example of an elongated, straight edge heart appliqé created by the template of FIG. 1.

FIG. 4A illustrates an example use of the template 10 to create an elongated, straight-edged heart. First the user folds the material 40 and places the fold line 60 on a right-hand side of the cutting mat 42. The user then places the linear curve portion 28 on the material (i.e., to the left of the fold 60) and aligns a marking of the second subset of the curvature markings 34-2, such as the 90° mark, with the fold 60. The user then aligns a depth marking 37 of the linear curve portion 28, such as the "y" mark, with the fold 60. The user then utilizes a rotary cutter 14 to cut from the 90° mark along the first circular portion 18 and along the linear curve portion 28 to the "y" mark. Once completed, the user can remove the template 10 from the material 40 and can unfold the cut material into the shape of an elongated, straight-edged heart 70 appliqué element, as illustrated in FIG. 4B.

Figure 5A:
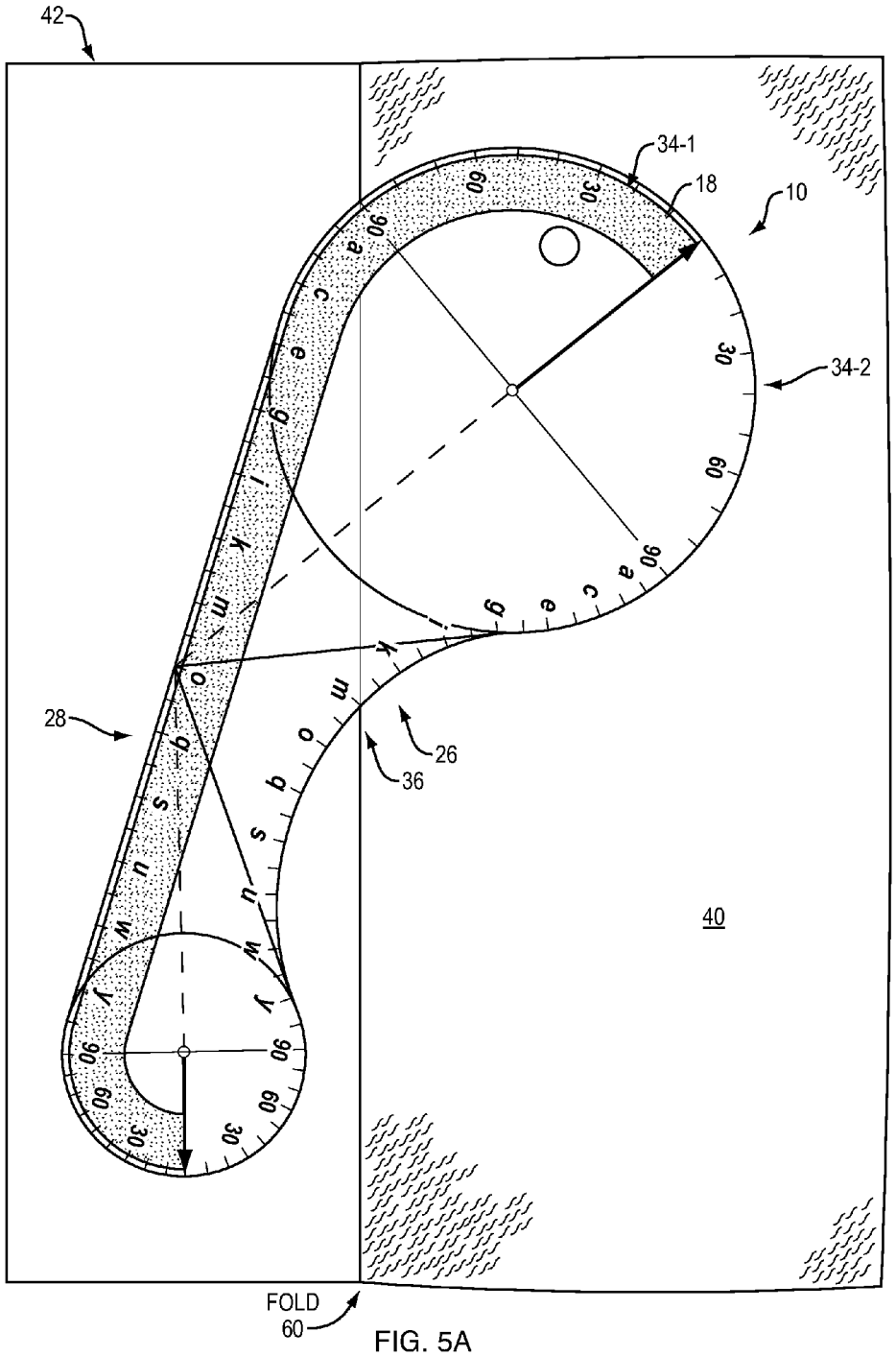
FIG. 5A illustrates the use of the template of FIG. 1 to create a short, round edge heart.
Figure 5B:
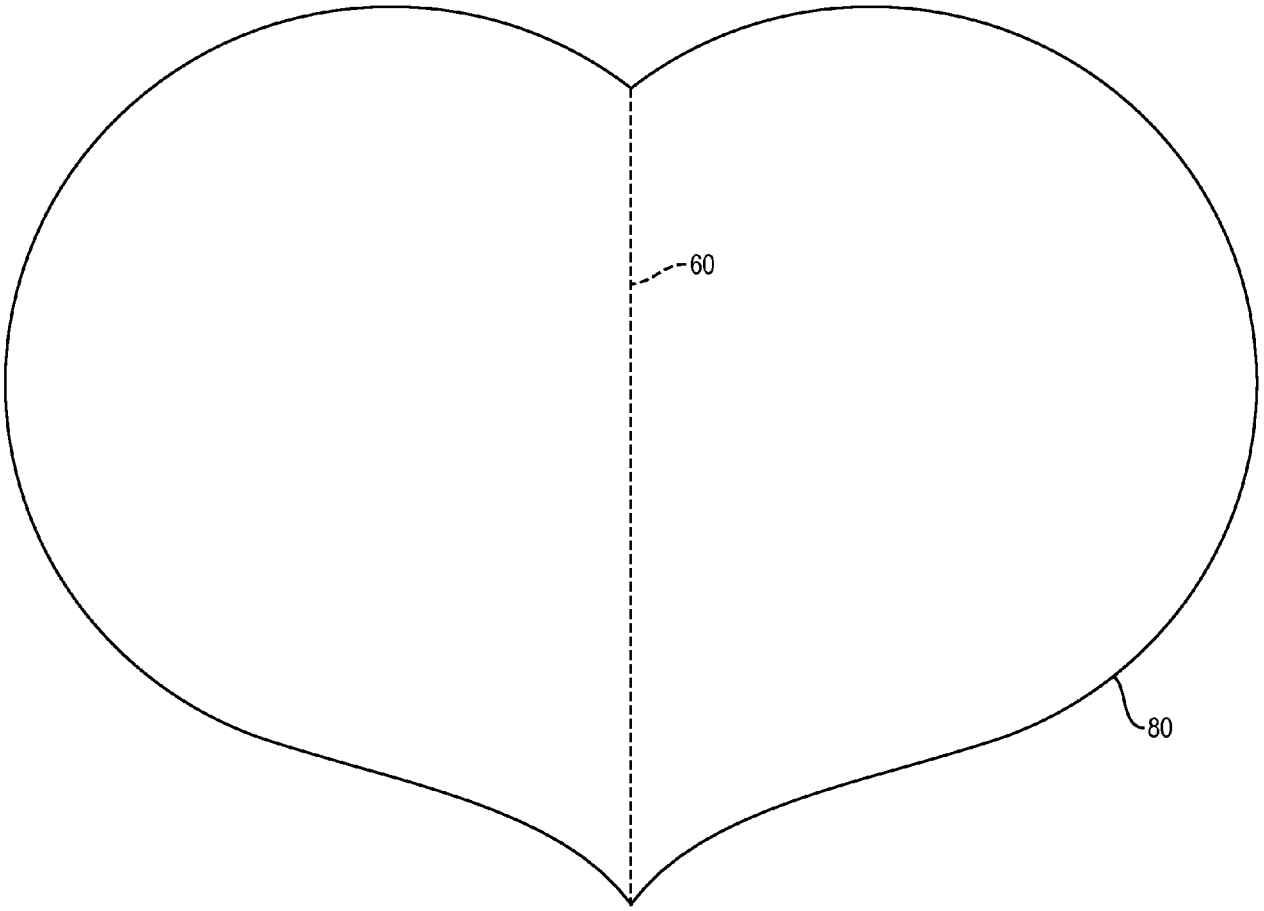
FIG. 5B illustrates an example of a short, round edge heart appliqé created by the template in FIG. 1.

FIG. 5A illustrates the use of the template 10 to create a short, round-edged heart. First the user folds the material 40 and places the fold line 60 on a left-hand side of the cutting mat 42. The user then places the linear curve portion 28 on the mat 42 (i.e., to the left of the fold 60) and aligns a marking of the first subset of the curvature markings 34-1, such as the 90° mark, with the fold 60. The user then aligns a depth marking 36 of the concave curve portion 26, such as the "m" mark, with the fold 60. The user then utilizes a rotary cutter 14 to cut from the 90° mark along the first circular portion 18 and along the concave curve portion 26 to the "m" mark. Once completed, the user can remove the template 10 from the material 40 and can unfold the cut material into the shape of a short, round-edged heart 80 appliqé element, as illustrated in FIG. 5B.

Figure 6A:
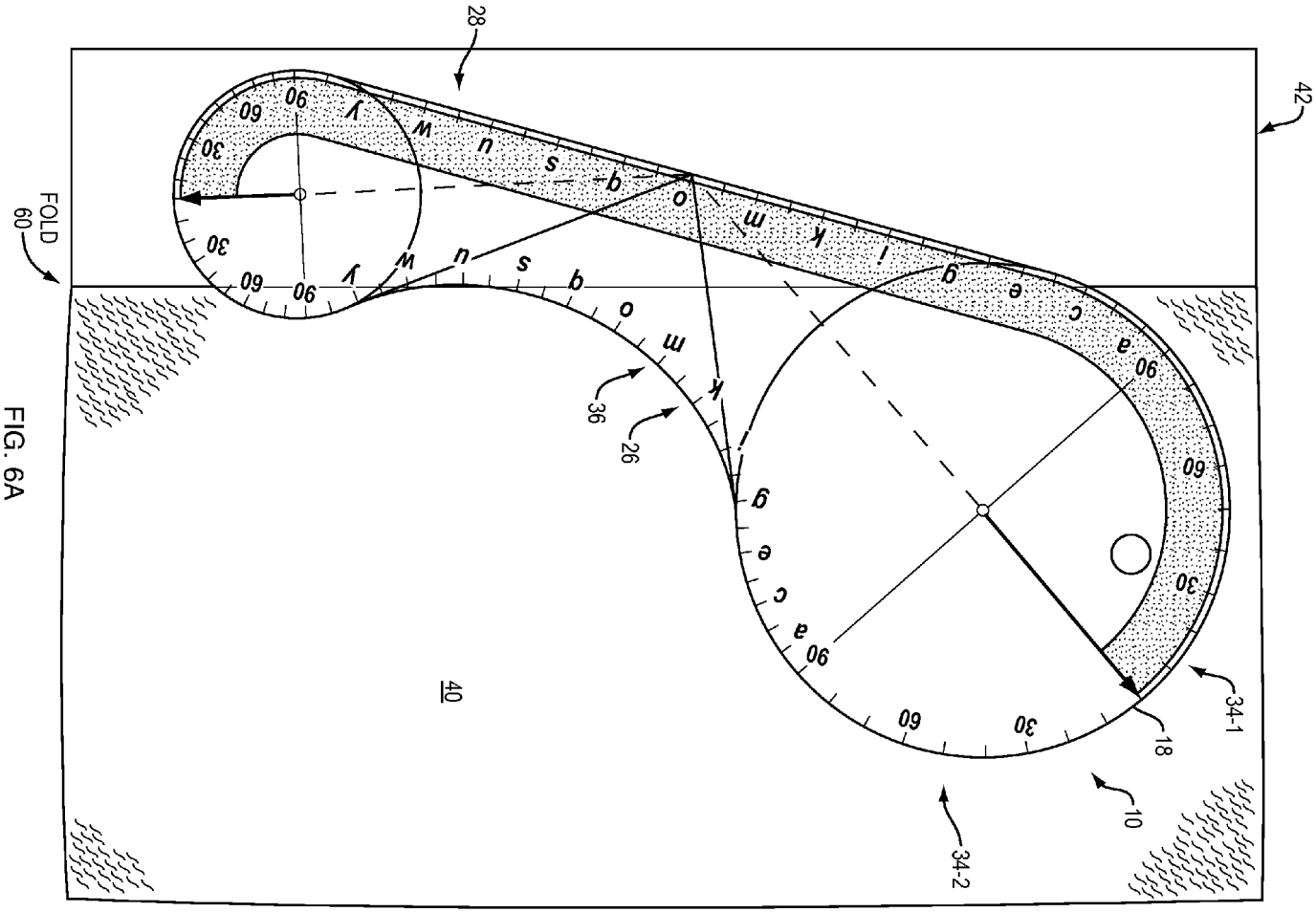
FIG. 6A illustrates the use of the template of FIG. 1 to create an elongated, round edge heart.
Figure 6B:
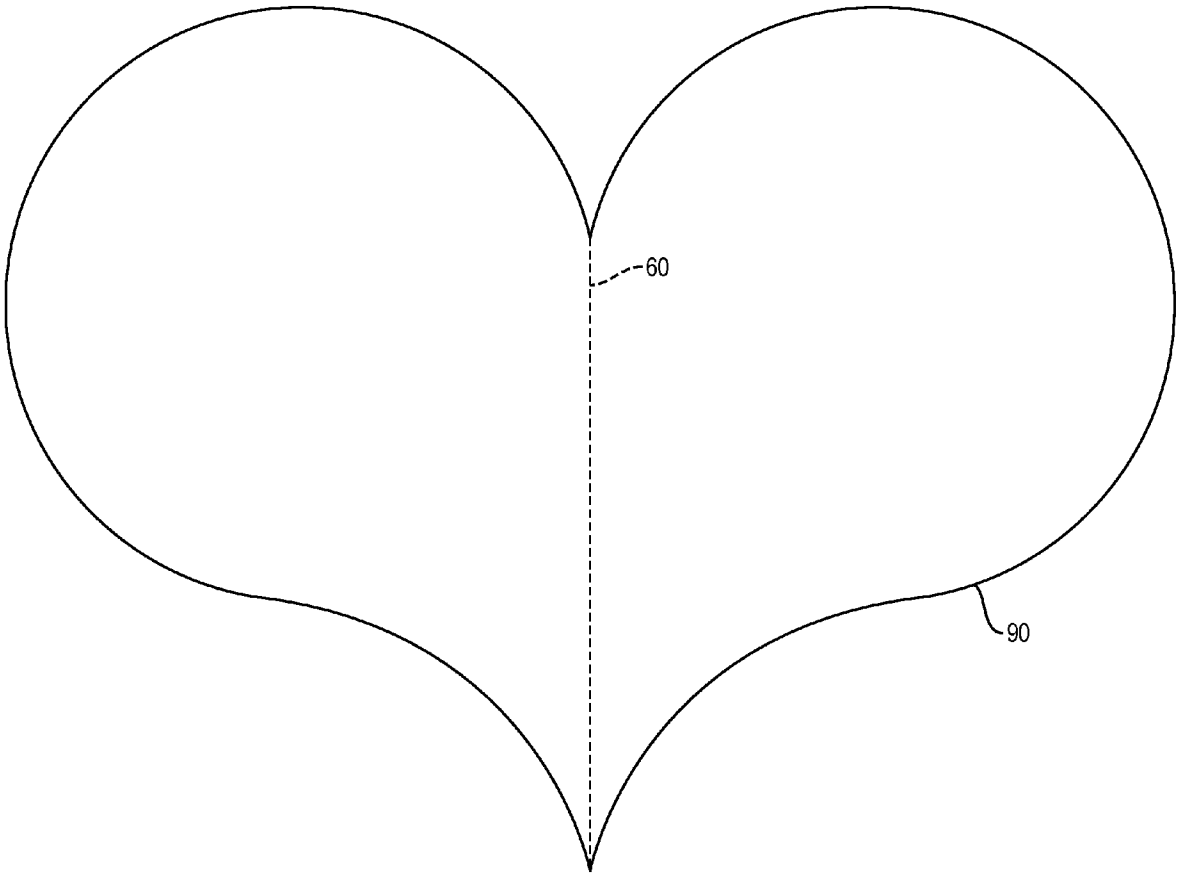
FIG. 6B illustrates the use of the template of FIG. 1 to create an elongated, round edge heart.

FIG. 6A illustrates the use of the template 10 to create an elongated, round-edged heart. First the user folds the material 40 and places the fold 60 on a left-hand side of the cutting mat 42. The user then places the linear curve portion 28 on the mat 42 (i.e., to the left of the fold 60), and aligns a marking of the first subset of the curvature markings 34-1, such as the "c" mark with the fold 60. The user then aligns a depth marking 36 of the concave curve portion 26, such as the "s" mark, with the fold 60. The user then utilizes a rotary cutter 14 to cut from the "c" mark along the first circular portion 18 and along the concave curve portion 26 to the "s" mark. Once completed, the user can remove the template 10 from the material 40 and can unfold the cut material into the shape of an elongated, round-edged heart 90 appliqé element, as illustrated in FIG. 6B.

Figure 7:
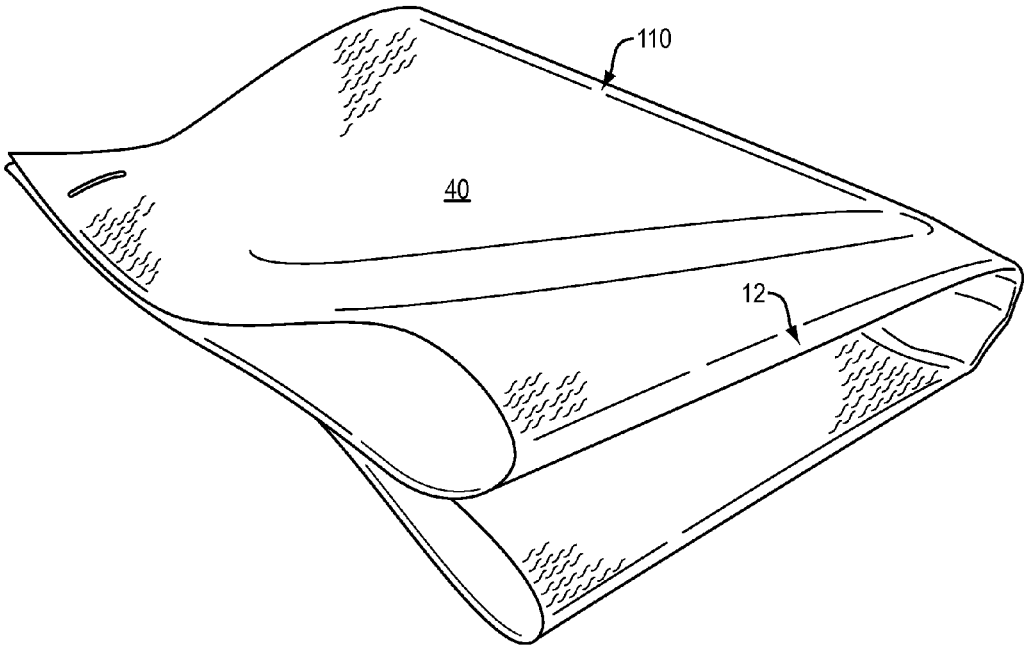
FIG. 7 illustrates a folding pattern for a piece of material for the creation of a four petal flower.
Figure 8:
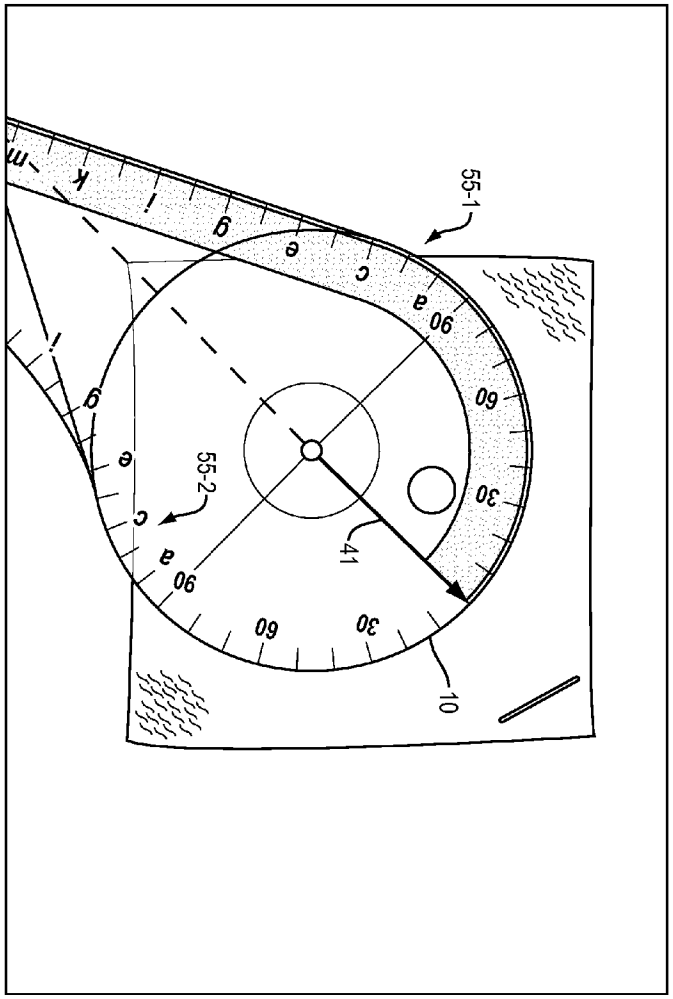
FIG. 8 illustrates the use of the template of FIG. 1 to create a four petal flower.

FIGS. 7 and 8 illustrate the use of the template of FIG. 1 to create a four petal flower shaped appliqé element. For example, as shown in FIG. 7, the user folds the material 40 in half, then in half again. The user can then staple all four corners of the material to eliminate slipping when cutting.

As shown in FIG. 8, the user places the template 10 over the folded corner and aligns a centering line 41 of the template 10 with the opposing corners. The user then cuts along the first circular portion 18 from the "b" mark 55-1 to the "b" mark 55-2.

Figure 9:
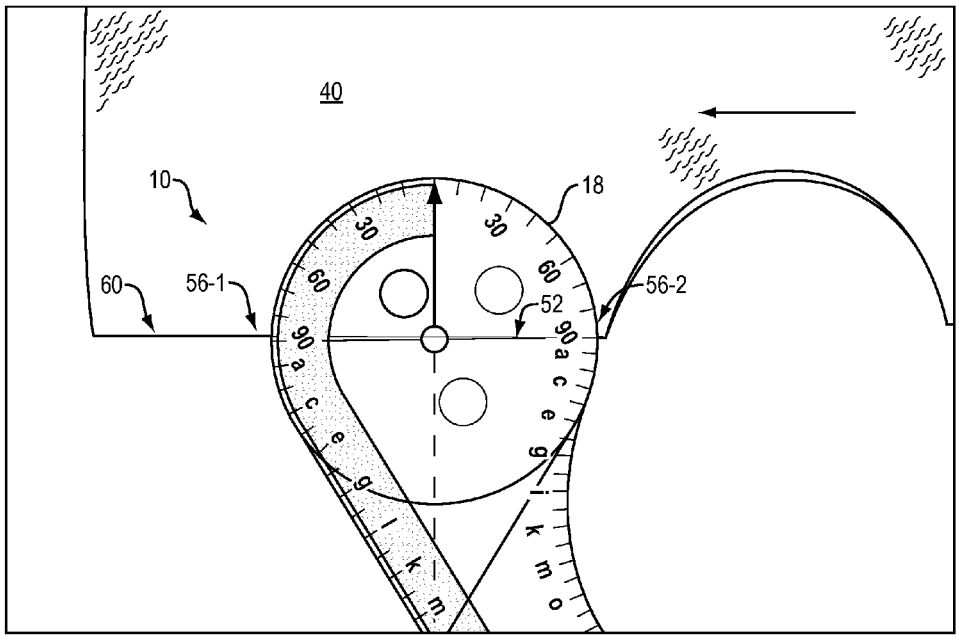
FIG. 9 illustrates the use of the template of FIG. 1 to create a circle.

FIG. 9 illustrates the use of the template of FIG. 1 to create a circle shaped appliqué element. First the user folds the material 40 and places the template 10 over the material such that the 90° markings and the straight line 52 of the first circular portion 18 along the fold 60 of the material 40. The user then utilizes a rotary cutter 14 to cut between the first and second 90° markings 56-1, 56-2 along the first circular portion 18. Once completed, the user can remove the template 10 from the material 40 and can unfold the cut material into the shape of a circle. As indicated in FIG. 9, the user can move the template 10 and repeat the process along the fold 60 to minimize material waste.

Figure 10:
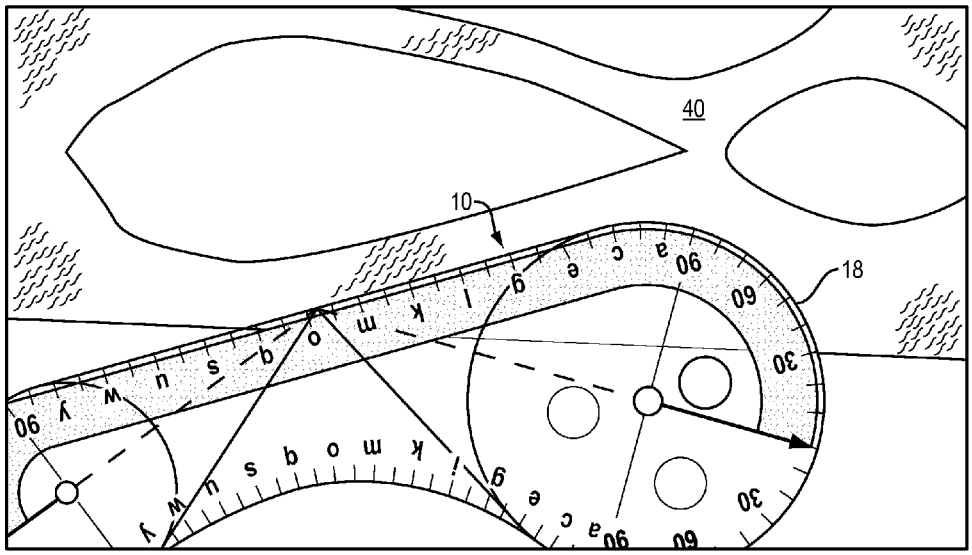
FIG. 10 illustrates the use of the template of FIG. 1 to create a teardrop shape.

FIG. 10 illustrates the use of the template of FIG. 1 to create a teardrop shaped appliqué element. For example, the user can fold the material 40 and place the template 10 over the material such that linear curve portion 28 is disposed to the right of the fold the fold 60 of the material 40. The user then aligns the 30° mark of the first set of markings 34, as associated with first circular portion 18, with the fold 60, and aligns the "q" mark of the second set of markings 36, as associated with the linear curve portion 28, with the fold 60. The user then utilizes a rotary cutter 14 to cut between the 30° mark and the "q" mark. It should be noted that a variety of different start and finish markings can be utilized to generate a variety of differently sized and shaped teardrop elements.

Figure 11:
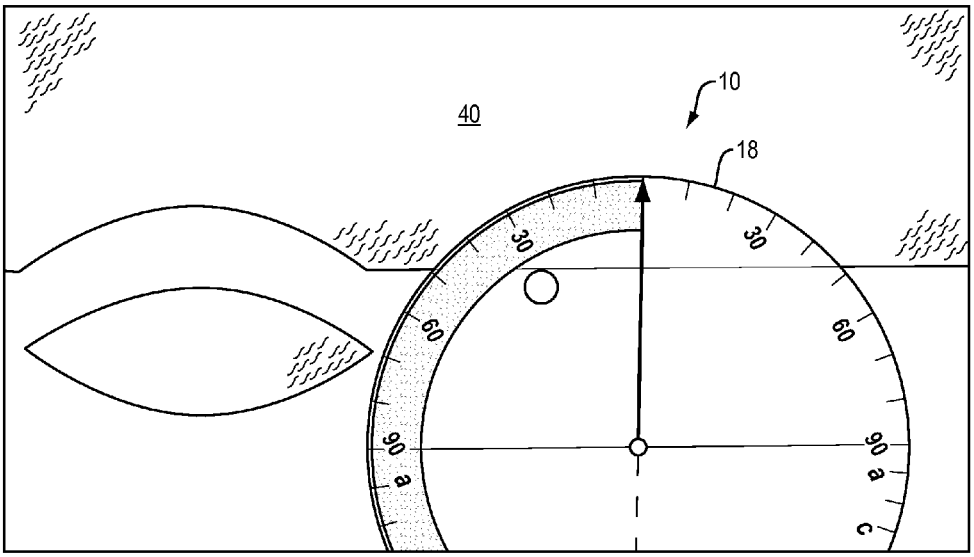
FIG. 11 illustrates the use of the template of FIG. 1 to create a leave shape.

FIG. 11 illustrates the use of the template of FIG. 1 to create a leave shaped appliqué element. For example, the user can cut leaves of varying widths, the largest being between about 60° to 60° and the smallest being between about 30° to 30°. The user can adjust the sizes in between by choosing two lines, they do not have to have the same label. For example, the user can cut a leaf from 50° to 40° that is between 50°/50° and 40°/40°. This provides the user with seven differently sized leaves on each end of each of the four templates, for a total of 56 leaf sizes.

Figure 12:
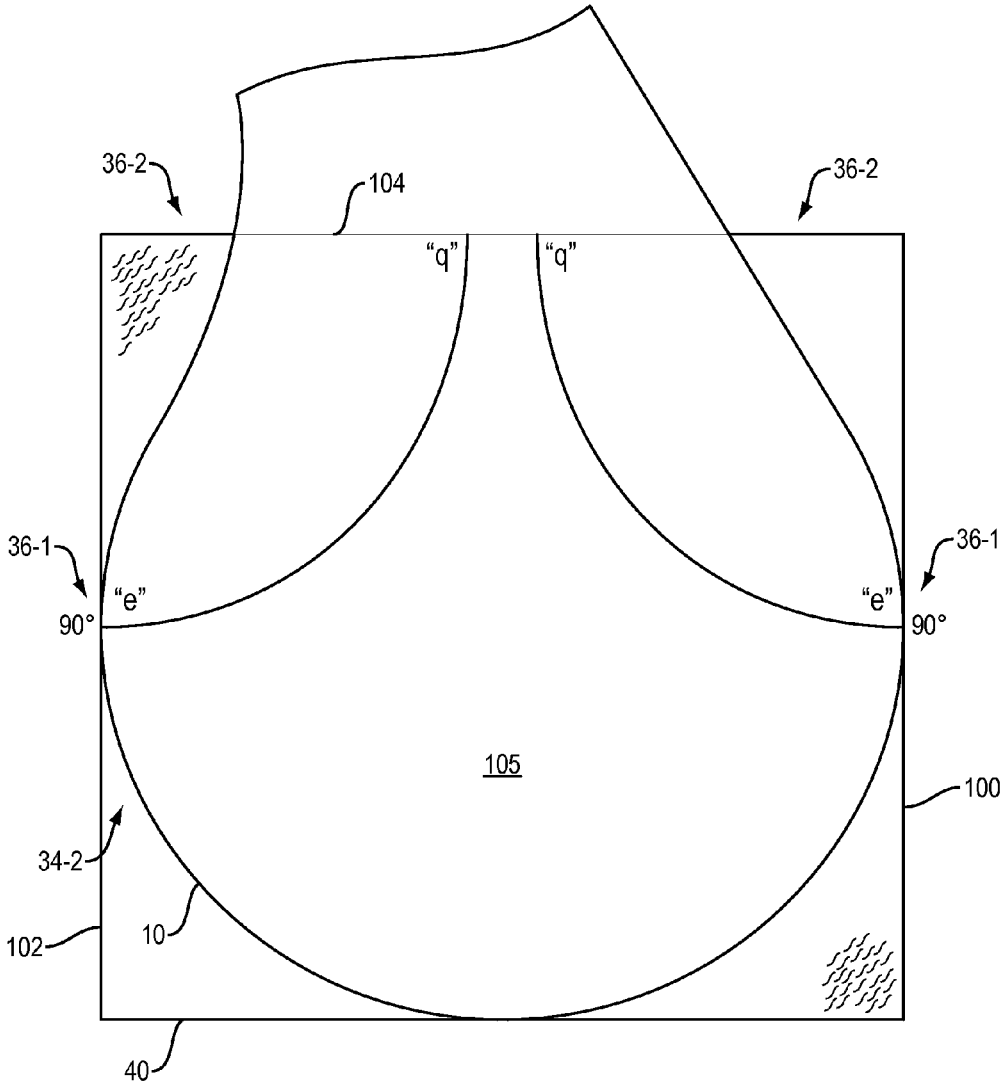
FIG. 12 illustrates the use of the template to create a clamshell shaped appliqué.

FIG. 12 illustrates the use of the template of FIG. 1 to create a clamshell shaped appliqué element. For example, the user can place the first circular portion 18 of the template 10 on a single piece of material 40, such as a five inch by five inch square piece of material. The user then aligns the 90° mark of the first subset of the curvature markings 34-1 with a first edge 100 of the material 40, aligns the 90° mark of the second subset of the curvature markings 34-2 with a second edge 102 of the material 40, and cuts along the template 10 between the 90° marks. The user then moves the template 10 to align a first depth marking 36 of the concave curve portion 26, such as "e", with the first edge 100 of the material 40 and to align a second depth marking 36 of the concave curve portion 26, such as "o", with a bottom edge 104 of the material 40. The user then cuts along the template 10 between the first and second depth markings 36-1, 36-2. The user repeats this process with respect to the second edge 10 of the material to generate the clamshell shaped appliqé element.

Figure 13:
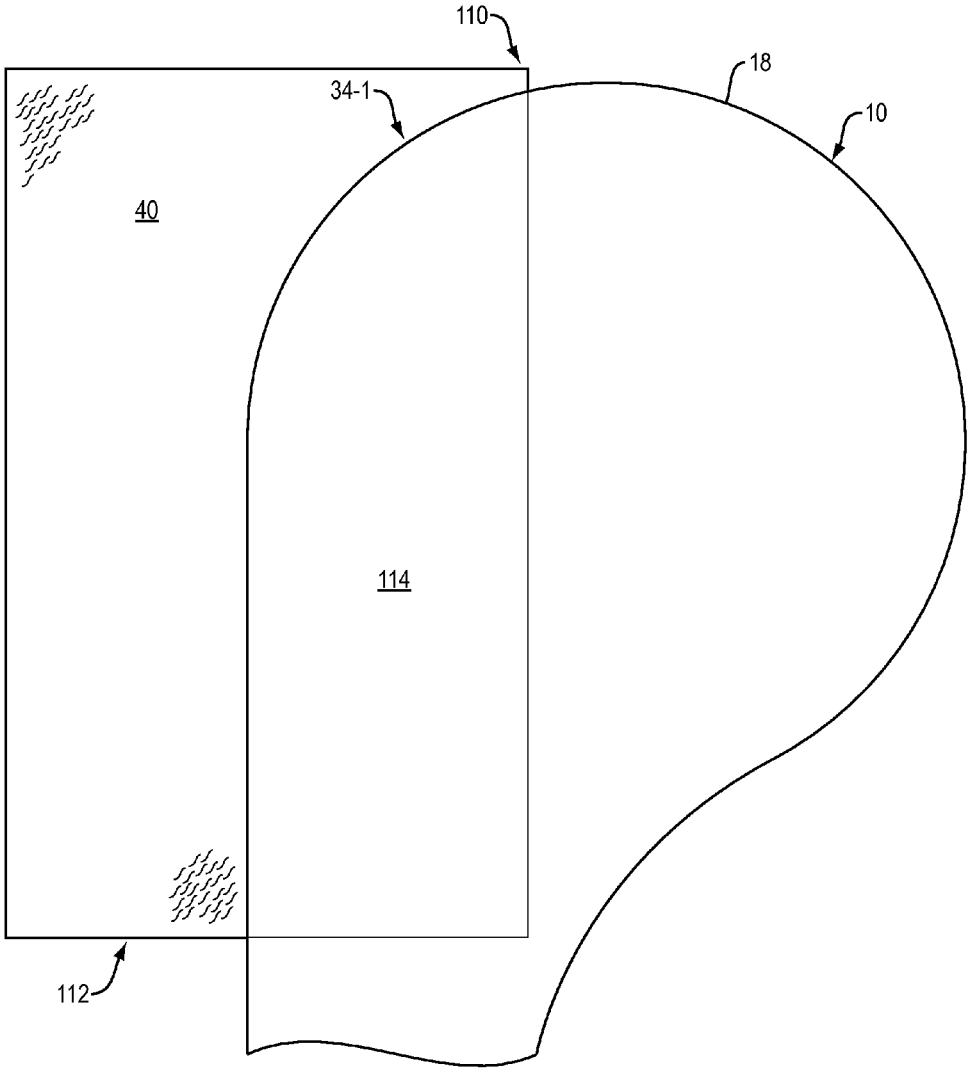
FIG. 13 illustrates the use of the template to create an oval shaped appliqué.

FIG. 13 illustrates the use of the template of FIG. 1 to create an oval shaped appliqué element. For example, the user can place the first circular portion 18 of the template 10 on a piece of material 40 double folded as illustrated in FIG. 7 and then align a mark of the first subset of the curvature markings 34-1, such as a 40° mark, with a single folded edge 110 of the material 40. The user then cuts along the template 10 between the 40° mark and a double folded edge 112 of the material 40. The user unfolds the cut portion 114 to generate the oval shaped appliqué element.

Figure 14:
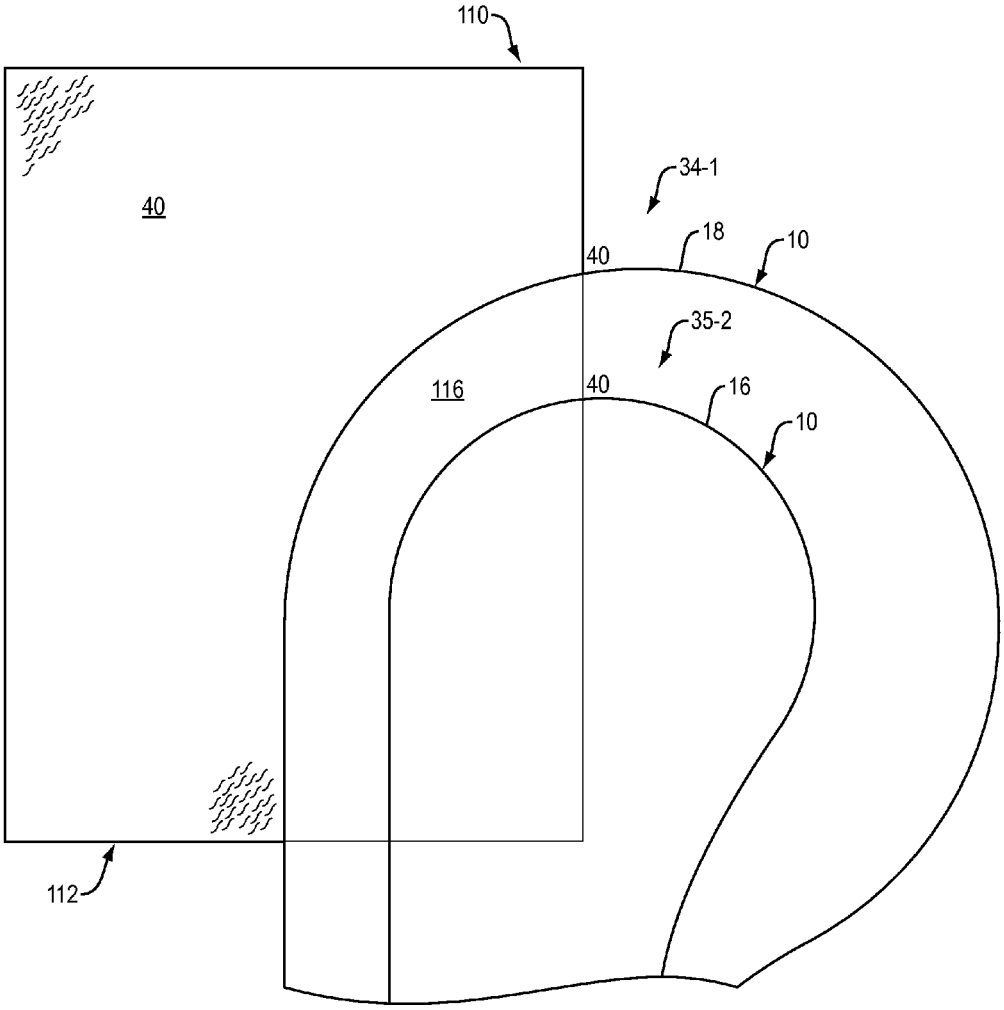
FIG. 14 illustrates the use of the template to create a ring shaped appliqué.

FIG. 14 illustrates the use of the template of FIG. 1 to create a ring shaped appliqué element. For example, the user can place the second circular portion 16 of the template 10 on a piece of material 40 double folded as illustrated in FIG. 7 and then align a mark of the second subset of the curvature markings 35-2, such as a 40° mark, with a single folded edge 110 of the material 40. The user then places the first circular portion 18 of the template 10 on the material 40 and aligns a mark of the first subset of the curvature markings 34-1, such as a 40° mark, with the single folded edge 110 of the material 40. The user then cuts along the template 10 between the 40° mark and the double folded edge 112 of the material 40. The user unfolds the cut portion 116 to generate the ring shaped appliqé element.

While various embodiments of the innovation have been particularly shown and described, it will be understood by those skilled in the art that various changes in form and details may be made therein without departing from the spirit and scope of the innovation as defined by the appended claims.

For example, with reference to FIG. 1, the first circular portion 18 and the second circular portion 22 can each define a corresponding opening 50, 53 extending through the thickness 12 of the template 10. The openings are configured to allow the marking of the center of a circle on a piece of material thereby allowing the user to create concentric circles on a piece of material.

In another example, with reference to FIG. 2, the template 10 can include a set of gripping elements 80 configured to limit movement of the template 10 relative to the material 42 during use.

What is claimed is:

1. A template, comprising:

a sheet of substantially flat material defining a thickness and having a first end and a second end, the first end opposing the second end, at least one of the first end and the second end defining a circular portion having a radius;

the sheet defining a concave curve portion disposed between the first end and the second end along a first side edge of the sheet;

the sheet defining a linear portion disposed between the first end and the second end along a second side edge of the sheet, the second side edge opposing the first side edge; and a set of template markings disposed on the sheet, the set of template markings configured to define a cutting shape;

wherein the at least one of the first end and the second end defining the circular portion having the radius comprises:

the first end defining a first circular portion having a first radius and a first arc extending between the linear portion and the concave curve portion, the first arc defining a first central angle of greater than 180° and the first radius being substantially constant along the first arc; and the second end defining a second circular portion having a second radius and a second arc extending between the linear portion and the concave curve portion, the second arc defining a second central angle of greater than 180° and the second radius being substantially constant along the second arc, the second radius being distinct from the first radius of the first circular portion.

2. The template of claim 1, wherein the set of template markings comprises:

a first set of curvature markings disposed on the first circular portion, the first set of curvature markings configured to define an angle of curvature of the template relative to a piece of material; and a second set of curvature markings disposed on the second circular portion, the second set of curvature markings configured to define an angle of curvature of the template relative to a piece of material.

3. The template of claim 2, wherein:

the first set of curvature markings are configured as numerical markings that indicate the angular locations of the outer periphery of the first circular portion; and the second set of curvature markings are configured as numerical markings that indicate the angular locations of the outer periphery of the second circular portion.

4. The template of claim 3, further comprising a visual indicator extending between the first end and the second end, the visual indicator configured to distinguish a first subset of numerical markings of the first set of curvature markings from a second subset of numerical markings of the first set of curvature markings.

5. The template of claim 3, further comprising a visual indicator extending between the first end and the second end, the visual indicator configured to distinguish a first subset of numerical markings of the second set of curvature markings from a second subset of numerical markings of the second set of curvature markings.

6. The template of claim 1, wherein the set of template markings comprises:

a set of concave curve depth markings disposed on the concave curve portion, the set of concave curve depth markings configured to define a depth of curvature of the template relative to a piece of material; and a set of linear curve depth markings disposed on the linear portion, the set of linear curve depth markings configured to define a depth of curvature of the template relative to a piece of material.

7. The template of claim 6, wherein:

the set of concave curve depth markings are configured as lower case letters that define the depth of curvature of the template relative to the piece of material; and the set of linear curve depth markings are configured as upper case letters that define the depth of curvature of the template relative to the piece of material.

8. The template of claim 1, wherein the set of template markings comprises a set of curvature markings disposed on the circular portion of the at least one of the first end and the second end of the sheet.

9. The template of claim 1, wherein the thickness of the sheet comprises a thickness of between about 1/16 inch and 1/4 inch.

10. The template of claim 9, wherein the thickness of the sheet comprises a thickness of about 1/8 inch.

11. The template of claim 1, wherein the sheet comprises a set of gripping elements configured to limit movement of the template relative to a material surface.

12. The template of claim 1, wherein:

the first arc of the first circular portion defines a first central angle of about 290° ; and the second arc of the second circular portion defines a second central angle of about 220° .

13. A method for creating a heart-shaped appliqué element, comprising:

folding a piece of material such that a first portion of the material overlaps a second portion of the material, the folded material defining a fold line;

placing the template on the folded material, the template including:

a sheet of substantially flat material defining a thickness and having a first end and a second end, the first end opposing the second end, at least one of the first end and the second end defining a circular portion having a radius, the sheet defining a concave curve portion disposed between the first end and the second end along a first side edge of the sheet, the sheet defining a linear portion disposed between the first end and the second end along a second side edge of the sheet, the second side edge opposing the first side edge, and a set of template markings disposed on the sheet, the set of template markings configured to define a cutting shape, aligning a template marking associated with the circular portion of the at least one of the first end and the second end with the fold line;

aligning a template marking associated with one of the concave curve portion and the linear portion with the fold line;

cutting the material outlined by template between the template marking associated with the circular portion and the template marking associated with one of the concave curve portion and the linear portion.

14. A template, comprising:

a sheet of substantially flat material defining a thickness and having a first end and a second end, the first end opposing the second end, the first end defining a first circular portion having a first radius and the second end defining a second circular portion having a second radius, the second radius being distinct from the first radius of the first circular portion;

the sheet defining a concave curve portion disposed between the first end and the second end along a first side edge of the sheet;

the sheet defining a linear portion disposed between the first end and the second end along a second side edge of the sheet, the second side edge opposing the first side edge;

a first set of curvature markings disposed on the first circular portion, the first set of curvature markings configured to define an angle of curvature of the template relative to a piece of material;

a second set of curvature markings disposed on the second circular portion, the second set of curvature markings configured to define an angle of curvature of the template relative to a piece of material;

a set of concave curve depth markings disposed on the concave curve portion, the set of concave curve depth markings configured to define a depth of curvature of the template relative to a piece of material; and a set of linear curve depth markings disposed on the linear portion, the set of linear curve depth markings configured to define a depth of curvature of the template relative to a piece of material wherein:

the first end defining the first circular portion having the first radius comprises a first arc extending between the linear portion and the concave curve portion, the first arc defining a first central angle of greater than 180° and the first radius being substantially constant along the first arc; and the second end defining the second circular portion having the second radius comprises a second arc extending between the linear portion and the concave curve portion, the second arc defining a second central angle of greater than 180° and the second radius being substantially constant along the second arc.

15. The template of claim 14, wherein:

the first arc of the first circular portion defines a first central angle of about 290° ; and the second arc of the second circular portion defines a second central angle of about 220° .

* * * * *